US006454050B2

(12) United States Patent
Gibson et al.

(10) Patent No.: US 6,454,050 B2
(45) **Date of Patent: *Sep. 24, 2002**

(54) FOLDABLE STEP STOOL WITH LEG LOCK AND HANDLE

(75) Inventors: William R. Gibson, Kent, OH (US); Enrique R. Giner, Huntington Woods, MI (US); Maria Antonieta Moreno-Giner, Huntington Woods, MI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/836,656

(22) Filed: Apr. 17, 2001

Related U.S. Application Data

(60) Provisional application No. 60/224,488, filed on Aug. 11, 2000.

(51) Int. Cl.[7] ..... E06C 1/00

(52) U.S. Cl. ..... 182/161; 182/129; 182/165; 280/642

(58) Field of Search ..... 182/161, 162, 182/163, 164, 165, 104, 127, 129, 156, 180.1

(56) References Cited

U.S. PATENT DOCUMENTS

| | | | | |
|---|---|---|---|---|
| 1,557,490 A | | 10/1925 | Videtta | |
| 1,817,233 A | | 8/1931 | Bumgardner | |
| 2,776,856 A | | 1/1957 | Ingram | |
| 2,873,995 A | | 2/1959 | Turner | |
| 2,908,362 A | | 10/1959 | Burtchaell | |
| 2,967,730 A | | 1/1961 | Vann | |
| 2,997,326 A | | 8/1961 | Daum | |
| 3,718,242 A | | 2/1973 | Larson | |
| 3,892,343 A | | 7/1975 | Warner | |
| 4,483,415 A | | 11/1984 | Disston et al. | |
| 4,485,892 A | * | 12/1984 | Maloney et al. | 182/161 |
| 4,707,883 A | | 11/1987 | Irani et al. | |
| 4,842,315 A | | 6/1989 | Nordmeyer | |
| 5,158,151 A | * | 10/1992 | Chang | 182/159 |
| 5,161,843 A | | 11/1992 | Baldwin | |
| 5,170,862 A | * | 12/1992 | Chang | 182/159 |
| 5,210,904 A | | 5/1993 | Pratt | |
| 5,232,796 A | | 8/1993 | Baumgartner | |
| 5,511,289 A | | 4/1996 | Bush et al. | |
| 5,762,163 A | * | 6/1998 | Kain | 182/161 |
| 5,937,968 A | * | 8/1999 | Gibson et al. | 182/165 |
| 5,992,567 A | * | 11/1999 | Chiu | 182/161 |
| 6,026,933 A | * | 2/2000 | King et al. | 182/165 |
| 6,039,149 A | * | 3/2000 | Bedja et al. | 182/20 |
| 2002/0017431 A1 | * | 2/2002 | Gibson et al. | 182/161 |

* cited by examiner

*Primary Examiner*—Bruce A. Lev
(74) *Attorney, Agent, or Firm*—Barnes & Thornburg

(57) ABSTRACT

A step stool includes a foldable frame having a front leg and a rear leg movable relative to the front leg and a carrying handle supported for pivotable movement on one of the legs about a pivot axis. A retainer member is coupled to the handle to move with the handle about the pivot axis to lock the front leg to the rear leg.

24 Claims, 4 Drawing Sheets

212
248
11
250
252
244
252
220
246
267
218
267
242
268
268
258
214
13
230
271
260
265
258
28
14
12
16
31

218
268
220
267
244
214
254
267
268
238
13
230
252
248
242
252
28
252
250
14
246
260
12
16
31

FOLDABLE STEP STOOL WITH LEG LOCK AND HANDLE

This application claims priority under 35 U.S.C. 119(e) to U.S. Provisional Application Ser. No. 60/224,488, filed Aug. 11, 2000, which is expressly incorporated by reference herein.

BACKGROUND AND SUMMARY OF THE INVENTION

The present invention relates to a step stool, and particularly, to a foldable step stool having legs that move relative to one another between an opened use position and a closed storage position. More particularly, the present invention relates to a foldable step stool provided with a carrying handle for use when the step stool has been folded to assume the closed storage position.

Step stools have a frame and one or more steps that individuals use for elevation when reaching for objects, painting walls, or any everyday task where extra elevation would be helpful. Step stool frames are often foldable for ease of storage while the step stool is not being used.

According to the present invention, a foldable step stool includes a frame having a front leg and a rear leg coupled to the front leg for movement relative to the front leg, a handle, and a pivot support mount configured to support the handle for pivotable movement on the front leg about a pivot axis. A retainer is coupled to the handle to move therewith about the pivot axis and arranged to trap a portion of the rear leg between the pivot support mount and the retainer upon movement of the handle to a predetermined position relative to the rear leg to lock the front leg to the rear leg.

In preferred embodiments, the rear leg includes a leg member and a handle anchor coupled to the leg member. The handle anchor is configured to include the portion of the rear leg that is trapped between the pivot support mount and the retainer. The pivot support mount includes a foundation coupled to the front leg and a shaft coupled to the foundation to support the handle for pivotable movement relative to the front leg about the pivot axis.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 1 is a front perspective view of the step stool in the opened use position showing, on the right side of the step stool, a handle anchor coupled to an edge of the rear leg and a carrier lock coupled to an edge of the front leg;

FIG. 2 is a side view of the step stool of FIG. 1;

DETAILED DESCRIPTION OF THE DRAWINGS

Figure 5:
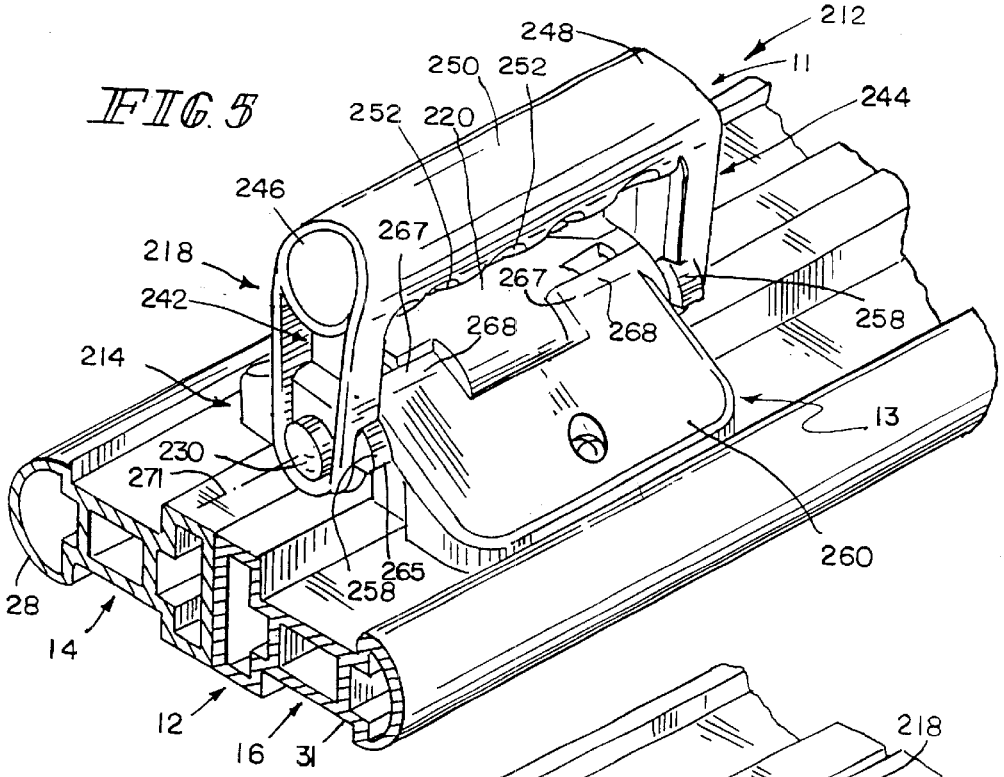
FIG. 5 is a view similar to FIGS. 3 and 4 showing movement of the handle to assume a stool-carrying position wherein the quarter-round retainer members on the handle trap the curved anchor members in a fixed position relative to the front leg between the retainer members and the pivot support mount to retain the rear leg in a fixed position alongside the front leg.
Figure 6:
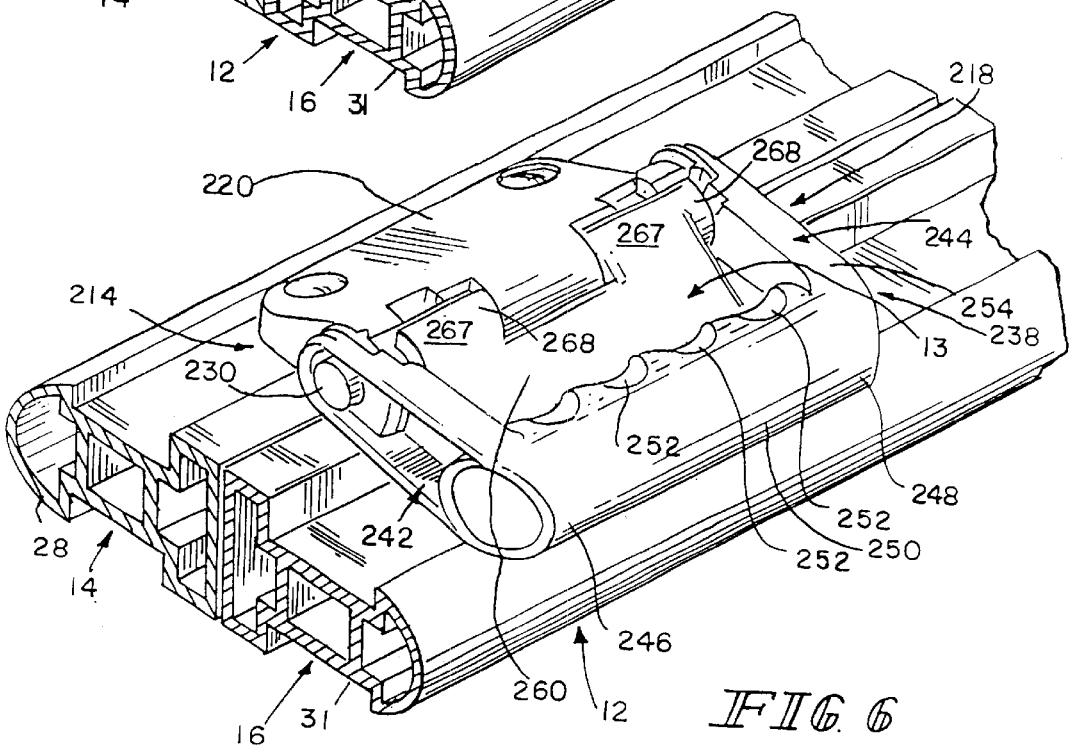
FIG. 6 is a view similar to FIGS. 3–5 showing continued rotation of the handle about its axis of rotation to assume a leg-locking "storage" position.

A foldable step stool 10 (shown, for example, in FIGS. 1 and 2) includes a leg lock and handle unit 212 that is configured to lock front and rear legs 14, 16 of step stool 10 together to retain rear leg 16 in a fixed position alongside front leg 14 as shown, for example, in FIGS. 5 and 6. Unit 212 includes a carrier lock 11 and a handle anchor 13. Carrier lock 11 is coupled to an edge of front leg 14 as shown, for example, in FIGS. 1 and 2. Handle anchor 13, adapted to mate with carrier lock 11, is coupled to an edge of rear leg 16 also shown, for example, in FIGS. 1 and 2. Locking rear leg 16 to front leg 14 facilitates transport and storage of folded step stool 10. The disclosure (including drawings) in U.S. application Ser. No. 09/636,440, filed Aug. 11, 2000 and titled "Foldable Step Stool with Leg Lock and Handle" to William R. Gibson, et al., is hereby incorporated by reference herein.

Figure 3:
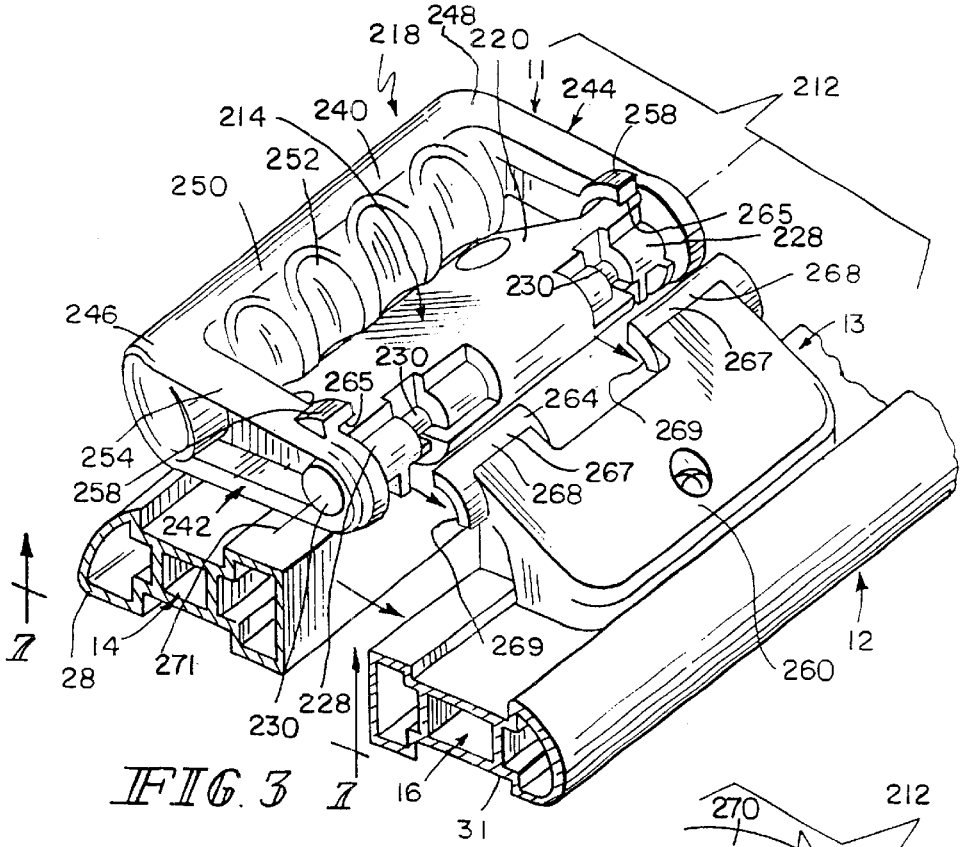
FIG. 3 is a perspective view of the leg lock and handle unit showing the carrier lock spaced-apart from the handle anchor and including a pivot support mount coupled to the front leg and a handle coupled to the pivot support mount, and also showing two retainer members coupled to the handle, and the handle anchor supported in a fixed position on the rear leg.
Figure 4:
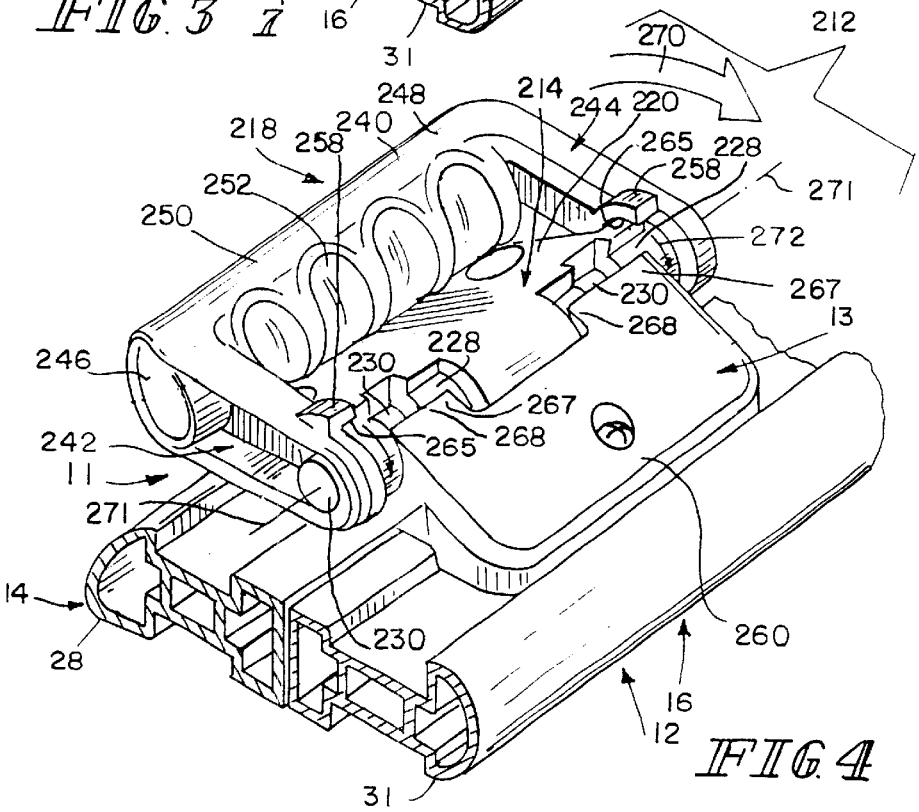
FIG. 4 is a view similar to FIG. 3 showing the mating of two curved anchor members of the handle anchor and the pivot support mount prior to rotation of the handle (in the direction of the arrow) to a position locking the front leg to the rear leg.

Carrier lock 11 includes a pivot support mount 214 that is fixed to front leg 14, a handle 218 pivotally coupled to pivot support mount 214, and a pair of retainer members 258 coupled to handle 218 as shown, for example, in FIGS. 3, 4, and 5. Retainer members 258 move in direction 272 in response to pivoting movement of handle 218 (in direction 270) about a pivot axis 271 from an "out-of-the-way" position shown in FIGS. 3 and 4 to assume a "stool-carrying" position as shown in FIG. 5 to trap curved anchor members 268 of handle anchor 13 between retainer members 258 and pivot support mount 214. Anchor members 268 are positioned to lie in spaced-apart relation to one another.

By trapping anchor members 268 between retainer members 258 and pivot support mount 214 as shown in FIGS. 5 and 6, handle 218 is "locked" to handle anchor 13 to retain rear leg 16 in a fixed position alongside front leg 14 after step stool 10 has been folded for transport or storage. The legs 14, 16 can be "unlocked" easily by rotation of handle 218 about pivot axis 271 from either one of the positions shown in FIGS. 5 and 6 to the position shown in FIGS. 3 and 4. When step stool 10 is opened, handle 218 is moved away from handle anchor 13 as shown, for example, in FIGS. 1–3. When step stool 10 is closed, handle 218 moves to mate with handle anchor 13 as suggested, for example, in FIGS. 4–6.

Figure 1:
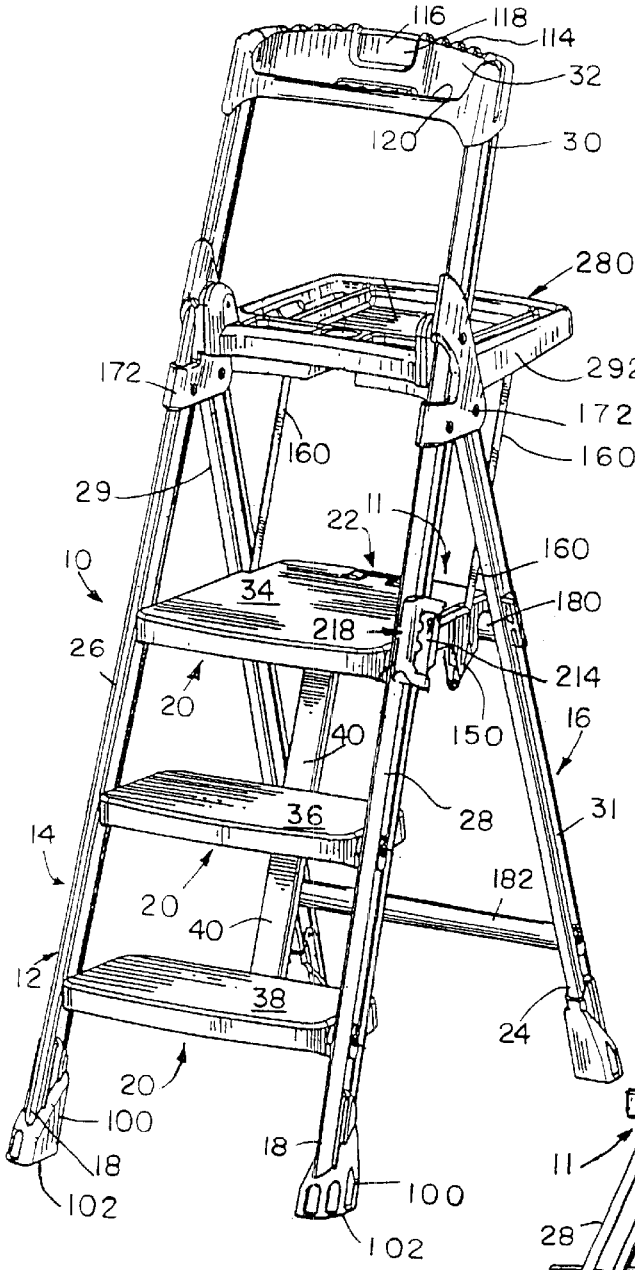
FIGS. 1 and 2 illustrate a step stool in accordance with the present invention, the step stool including a frame having front and rear legs arranged to lie in an opened use position and showing unmated portions of a leg lock and handle unit that are mounted on one side of the front and rear legs and configured to be mated as shown in FIGS. 3–6 to provide a side-mounted carrying handle that operates to lock the front leg to the rear leg when the step stool is folded to assume a closed storage position.

As shown in FIG. 1, step stool 10 includes a frame 12 having front legs 14 and rear legs 16, a set of steps 20 coupled to front leg 14, and a step latch 22 coupled to a top one of steps 20. Frame 12 of step stool 10 is foldable between an opened use position, shown in FIGS. 1 and 2, in which a bottom end 18 of front leg 14 is spaced-apart from a bottom end 24 of rear leg 16 and a closed or collapsed storage position, in which front and rear legs 14, 16 are folded together.

Frame 12 is converted easily between the use position and the storage position by lifting step latch 22 manually and moving set of steps 20 to a generally vertical position. As steps 20 are pivoted toward the generally vertical position, rear leg 16 pivots automatically toward front leg 14 causing step stool 10 to assume the collapsed, folded storage position.

As shown in FIG. 1, front leg 14 of frame 12 includes opposite leg members 26, 28 each including bottom end 18 and an opposite top end 30. A top bar handle portion 32 extends between leg members 26, 28 and steps 20 are spaced-apart from one another between top bar 32 and bottom end 18 of front leg 14. Steps 20 include top step 34, middle step 36, and bottom step 38 coupled together by a link 40. While leg members 26, 28 are preferably constructed of extruded aluminum, a wide variety of metallic and nonmetallic materials may be used.

Feet 100 are provided and are formed to extend over ends 18 of leg members 26, 28. Each foot 100 includes a base 102 configured to rest upon a generally flat surface (not shown).

Figure 2:
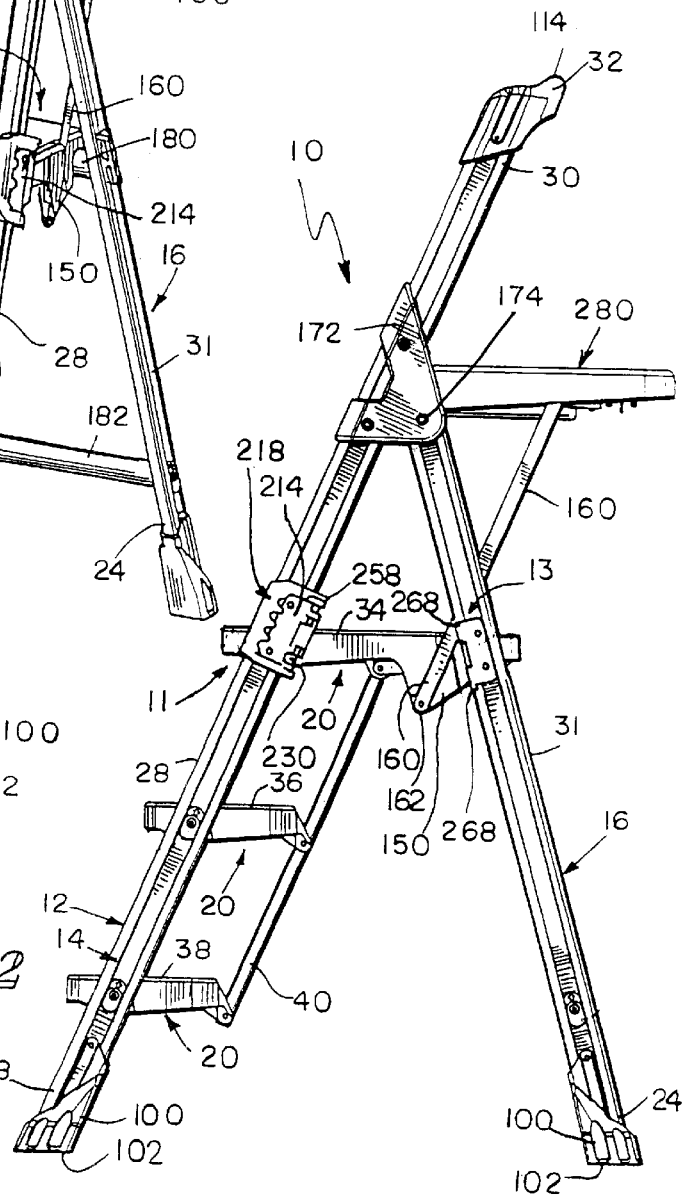

As shown in FIGS. 1 and 2, top bar 32 includes a top surface 114 extending between leg members 26, 28 and a hand grip 116 extending from top surface 114 to define a channel 118 sized to receive fingers (not shown) of a user gripping step stool 10. Top surface 114 is provided with ridges, as shown in FIG. 1. In addition to channel 118, the ridges may also be used has a hand grip area. In addition, top bar 32 includes a shelf 120 spaced-apart from top surface 114 to receive miscellaneous items such as screws, nails, bolts, nuts, etc. It is within the scope of the present disclosure to form shelf 120 to include spaced-apart apertures or recesses (not shown) that are sized to receive tool shafts (not shown).

As shown in FIGS. 1 and 2, a pair of tray links 160 are provided in step stool 10 coupled at a lower end thereof by a pivot pin 162 to an apex of flange 150. Each tray link 160 is further coupled at an upper end thereof to a flange of a utility tray 280 to pivotally couple tray 280 and top step 34 together.

Rear leg 16 of frame 12 is coupled to front leg by brackets 172, as shown in FIGS. 1 and 2. Each bracket 172 lies adjacent to and is pivotally coupled to utility tray 280. Bracket 172 further includes a pivot pin 174 to permit pivoting movement of rear leg 16 relative to front leg 14, although a wide variety of pins, rods, and the like may be used. Rear leg 16 includes first and second rear leg members 29, 31, upper cross strut 180, and a lower cross strut 182. Cross struts 180, 182 extend between and are coupled to rear leg members 29, 31.

Referring now to FIGS. 3–6, carrier lock 11 includes pivot support mount 214 coupled to leg member 28 of front leg 14. Handle anchor 13 is coupled to leg member 31 of rear leg 16, and handle 218 pivotally coupled to pivot support mount 214. When step stool 10 is in the storage position, handle 218 and pivot support mount 214 are formed to couple with handle anchor 13 in order to form leg lock and handle unit 212, as shown in FIGS. 4–6. Unit 212 is then positioned for use by a user so that step stool 10 may be carried by unit 212 to a storage area, for example, as described in detail herein.

Figure 7:
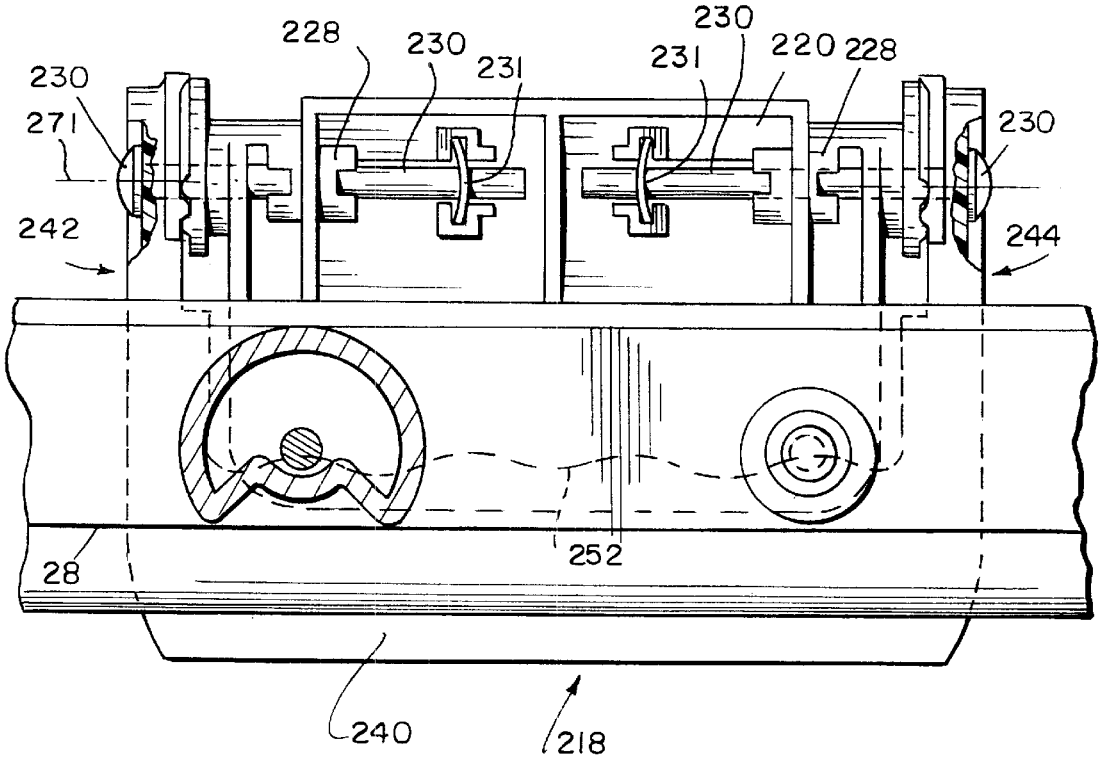
FIG. 7 is an elevation view taken along line 7—7 of FIG. 3 of the back side of the pivot support mount and handle showing two shafts of the carrier lock positioned to lie along the pivot axis and provided to couple the handle to the pivot support mount.

Pivot support mount 214 is coupled to leg member 28 of front leg 14, as shown in FIGS. 1–7. Referring now to FIGS. 3, 4, 6, and 7, pivot support mount 214 is formed to include a foundation or base 220 coupled to leg member 28 and shaft-receiving bearings 228 coupled to base 220. Pivot support mount further includes two shafts 230 which couple handle 218 to bearings 228. Each shaft 230 is located in a channel formed in bearings 228 as shown in FIG. 7. A pair of clips 231 couple each shaft 230 to base 220 of pivot support mount 214.

Handle 218 is formed to include grip portion 240, a first arm or grip support 242 coupled to grip portion 240 at one end and one of the shafts 230 at another end, and a second arm or grip support 244 positioned to lie in spaced-apart relation to first arm 242 and coupled to grip portion 240 and another of the shafts 230. Shafts 230 are positioned to lie along pivot axis 271. Grip portion 240 is further formed to include a first end 246, a second end 248, and a textured member 250 having indentations 252.

One retainer member 258 is coupled to each of the first and second arms 242, 244. Each retainer member 258 is a "quarter-round" flange forming a partial arc shape and is positioned to extend out from handle 218, as shown, for example, in FIGS. 3–5.

As mentioned above, handle anchor 13 is formed to include an anchor support 260 coupled to leg member 31 and a pair of curved anchor members 268 coupled to anchor support 260 and formed to receive bearings 228 partially therein, as shown in FIGS. 4–6. Each anchor member 268 is formed to include a concave inner surface 269 defining a channel receiving a portion of bearings 228 therein when rear leg 16 is locked to front leg 14.

In operation, handle anchor 13 is positioned to lie in spaced-apart relation to pivot support mount 214 and handle 218 when step stool 10 is in the opened, use position, as shown in FIGS. 1–3. When step stool 10 is in the closed, storage position, rear leg 16 and front leg 14 are positioned to lie alongside one another, as shown, for example, in FIGS. 4–6.

To lock leg member 28 of front leg 14 to leg member 31 of rear leg 16, leg lock and handle unit 212 is "secured" by rotating handle 218 in direction 270 about pivot axis 271, as shown in FIG. 4. Each anchor member 268 has a convex outer surface 267 configured to mate with a curved inner surface 265 of its companion retainer member 258. Once each retainer member 258 is positioned to trap each respective curved anchor member 268 against bearing 228, leg lock and handle unit 212 is in a "locked" position and front leg 14 is thus "locked" to rear leg 16.

As shown in FIG. 5, handle 218 is placed in a stool-carrying, upright position in order to secure unit 212. When handle 218 is in the upright position, a user may grasp the grip portion to carry step stool 10 to a storage area, for example. When step stool 10 is being stored, handle 218 may be further rotated so that the grip portion of handle 218 is positioned to lie adjacent leg member 31 of rear leg 16, as shown in FIG. 6. When handle 218 is positioned to lie adjacent to leg member 31 handle 218 is generally out of the way and step stool 10 is ready for storage.

Although the invention has been described in detail with reference to certain preferred embodiments, variations and modifications exist within the scope and spirit of the invention as described and defined in the following claims.

What is claimed is:

1. A step stool comprising a frame including a front leg and a rear leg coupled to the front leg for movement relative to the front leg, a handle, a pivot support mount configured to support the handle for pivotable movement on the front leg about a pivot axis, and a retainer member coupled to the handle to move therewith about the pivot axis and arranged to trap a portion of the rear leg between the pivot support mount and the retainer member upon movement of the handle to a predetermined position relative to the rear leg to lock the front leg to the rear leg when the legs are together in a collapsed position.

2. The step stool of claim 1, wherein the rear leg includes a leg member and a handle anchor coupled to the leg member and configured to include the portion of the rear leg.

3. The step stool of claim 2, wherein the portion of the rear leg is an anchor member formed to include a concave inner surface defining a channel receiving a portion of the pivot support mount therein when the rear leg is locked to the front leg.

4. The step stool of claim 3, wherein the pivot support mount includes a shaft coupled to the handle and a foundation fixed to the front leg and the foundation is arranged to support the shaft for rotation of the handle about the pivot axis formed by the shaft and to provide the portion of the pivot support mount received in the channel.

5. The step stool of claim 3, wherein the handle anchor further includes an anchor support coupled to the leg member and arranged to support the anchor member in spaced-apart relation to the leg member and in confronting relation to the portion of the pivot support mount upon movement of the rear leg to a position alongside the front leg.

6. The step stool of claim 3, wherein the portion of the pivot support mount is cylinder-shaped, the anchor member is curved and has a convex outer surface, and the retainer member includes a curved inner surface configured to mate with the convex outer surface of the anchor member.

7. The step stool of claim 3, wherein the handle includes a grip portion arranged to lie in spaced-apart parallel relation to the pivot support mount and a pair of grip supports coupled to the grip portion and the pivot support mount to maintain the grip portion in a fixed position relative to the pivot support mount, and the retainer member is coupled to at least one of the grip supports and arranged to define a space located between the retainer and the pivot support mount and adapted to receive the anchor member therein upon movement of the handle relative to the rear leg to the predetermined position.

8. The step stool of claim 1, wherein the retainer member is arranged to define a space located between the retainer member and the pivot support mount and adapted to receive the portion of the rear leg therein upon movement of the handle relative to the rear leg to the predetermined position.

9. The step stool of claim 8, wherein the pivot support mount includes a cylinder-shaped portion, the portion of the rear leg is a curved member including a concave inner surface shaped to mate with the cylinder-shaped portion of the pivot support mount and a convex outer surface, and the retainer member includes a curved inner surface shaped to mate with the convex outer surface of the curved member.

10. The step stool of claim 1, wherein the pivot support mount includes a curved exterior surface and the portion of the rear leg is an anchor member formed to include a concave inner surface defining a channel receiving the curved exterior surface of the pivot support mount therein when the rear leg is locked to the front leg.

11. The step stool of claim 10, wherein the anchor member is curved and has a convex outer surface and the retainer member includes a curved inner surface configured to mate with the convex outer surface of the anchor member.

12. The step stool of claim 10, wherein the handle further includes a grip portion adapted to be gripped by a person and a grip support arranged to interconnect the grip portion and the pivot support mount and the retainer member is coupled to the grip support and arranged to define a space located between the retainer member and the pivot support mount and adapted to receive the anchor member therein upon movement of the handle relative to the rear leg to the predetermined position.

13. A step stool comprising a frame including a front leg and a rear leg coupled to the front leg for movement relative to the front leg, a handle, a pivot support mount coupled to the front leg and arranged to support the handle for pivotable movement about a pivot axis, an anchor member supported in a fixed position on the rear leg and arranged to mate with the pivot support mount upon movement of the rear leg to lie alongside the front leg, and a retainer member coupled to the handle to move therewith about the pivot axis and arranged to retain the anchor member in a fixed position relative to the front leg upon movement of the handle about the pivot axis to assume a stool-carrying position when the anchor member is mated to the pivot support mount.

14. The step stool of claim 13, wherein pivot support mount includes a foundation fixed to the front leg and shaft supported for rotation along the pivot axis by the foundation and wherein the retainer member is positioned to lie in spaced-apart relation to the shaft to define a space therebetween and the portion of the handle anchor is positioned to lie in the space upon movement of the handle about the pivot axis to assume a stool-carrying position when the anchor member is mated to the pivot support mount.

15. The step stool of claim 14, wherein the pivot support mount includes a cylinder-shaped portion, the anchor member is curved and has a concave inner surface shaped to mate with the cylinder-shaped portion of the pivot support mount and a convex outer surface, and the retainer member includes a curved inner surface shaped to mate with the convex outer surface of the curved anchor member.

16. The step stool of claim 13, wherein the pivot support mount includes a base coupled to the front leg, a bearing coupled to the base and formed to include a passageway therein, and a shaft arranged to extend through the passageway and to lie along the pivot axis, the handle is coupled to the shaft to rotate about the pivot axis, and the retainer member is coupled to the handle to move therewith about the pivot axis.

17. The step stool of claim 16, wherein the anchor member is formed to include a concave inner surface defining a channel receiving a portion of the handle mount therein when the anchor member is mated to the handle mount.

18. A step stool comprising a frame including a front leg and a rear leg coupled to the front leg for movement relative to the front leg, a handle coupled to the front leg to pivot about a pivot axis, and means for locking the rear leg to the handle when the rear leg is positioned to lie alongside the front leg in response to movement of the handle relative to the front leg to retain the rear leg in a fixed position alongside the front leg.

19. The step stool of claim 18, wherein the locking means includes a handle anchor coupled to the rear leg and a retainer member coupled to the handle.

20. The step stool of claim 19, wherein the handle includes a grip portion and spaced-apart arms coupled to the grip portion and the retainer member is coupled to the arms to move therewith about the pivot axis and arranged to trap a portion of the handle anchor between the front leg and the retainer member upon movement of the handle about the pivot axis to assume a stool-carrying position when the rear leg lies in the fixed position alongside the front leg.

21. The step stool of claim 19, wherein the handle includes a grip portion arranged to lie in spaced-apart parallel relation to the pivot axis and a pair of grip supports coupled to the grip portion and arranged to lie in spaced-apart relation to one another, each grip support is mounted on the front leg to pivot about the pivot axis, and the retainer member is coupled to at least one of the grip supports.

22. The step stool of claim 21, wherein a portion of the front leg is cylinder-shaped, the handle anchor includes curved member having a convex outer surface, and the retainer member includes a curved inner surface configured to mate with the convex outer surface of the curved member.

23. The step stool of claim 18, wherein a portion of the locking means is located on the handle.

24. A step stool comprising a frame including a front leg and a rear leg movable relative to the front leg, a carrying handle supported for pivotable movement on one of the legs about a pivot axis and a retainer member coupled to the handle to move with the handle about the pivot axis to lock the front leg to the rear leg alongside each other.

* * * * *